US005427021A

United States Patent [19]

Conrad

[11] Patent Number: 5,427,021

[45] Date of Patent: Jun. 27, 1995

[54] CALENDER FOR MATERIAL WEBS OR THE LIKE

[75] Inventor: Hans-Rolf Conrad, Dormagen, Germany

[73] Assignee: Sulzer Papertec Krefeld GmbH, Krefeld, Germany

[21] Appl. No.: 196,395

[22] Filed: Feb. 14, 1994

[30] Foreign Application Priority Data

Feb. 13, 1993 [DE] Germany ..... 43 04 374.7

[51] Int. Cl.[6] ..... B30B 3/04; D21G 1/00

[52] U.S. Cl. ..... 100/70 R; 100/93 RP; 100/168; 100/173; 226/94; 425/174.8 E

[58] Field of Search ..... 100/70 R, 93 RP, 155 R, 100/168, 173, 176; 15/1.51; 226/94; 425/174.8 R, 174.8 E

[56] References Cited

U.S. PATENT DOCUMENTS

| | | | |
|---|---|---|---|
| 2,576,882 | 11/1951 | Koole et al. | 226/94 X |
| 3,528,592 | 9/1970 | White | 226/94 X |
| 3,893,800 | 7/1975 | Wako | 226/94 X |
| 3,912,257 | 10/1975 | Gibbons | 226/94 X |
| 4,673,284 | 6/1987 | Matsumoto et al. | 15/1.51 X |
| 4,741,942 | 5/1988 | Swift | 15/1.51 X |
| 5,011,395 | 4/1991 | Kawamata | 425/174.8 E |
| 5,030,999 | 7/1991 | Lindblad et al. | 15/1.51 X |

FOREIGN PATENT DOCUMENTS

| | | | |
|---|---|---|---|
| 0145635A2 | 6/1985 | European Pat. Off. . | |
| 3216182C2 | 2/1985 | Germany . | |
| 61-23079 | 1/1986 | Japan | 226/94 |
| 62-199427 | 9/1987 | Japan | 425/174.8 R |
| 1312263 | 4/1973 | United Kingdom . | |
| 1394805 | 5/1975 | United Kingdom . | |
| 1424499 | 2/1976 | United Kingdom . | |
| 1469983 | 4/1977 | United Kingdom . | |
| 1525789 | 7/1978 | United Kingdom . | |

*Primary Examiner*—Stephen F. Gerrity
*Attorney, Agent, or Firm*—Darby & Darby

[57] ABSTRACT

A calender for material webs of paper or the like comprises at least one pressing gap. At least one temperature controlled tempering roller is disposed adjacent to the gap. A charging device is disposed adjacent to the gap. The charging device electrostatically charges the material web before the material web contacts the tempering roller.

7 Claims, 1 Drawing Sheet

CALENDER FOR MATERIAL WEBS OR THE LIKE

FIELD OF THE INVENTION

The present invention relates to a calender for material webs of paper or the like. More specifically, the present invention relates to a calender for material webs of paper having at least one pressing gap and at least one heatable or coolable tempering roller.

BACKGROUND OF THE INVENTION

In known calenders (for example, DE-C-3 216 182), a material web of paper, magnetic strip or the like passes through one or more pressing gaps which are formed in each case between two pressing rollers. Here, heatable tempering rollers, particularly in the form of a heatable pressing roller, can be provided in order to deliver heat to the material web and hence improve deformation in the pressing gap. For this purpose, by means of guide rollers it is ensured that the material web rests on the tempering roller over a predetermined circumferential angle. There are also cases in which coolable tempering rollers are used, for example in the output section of the calender in order to cool down an excessively hot paper web before winding.

If the material web is to be applied to the surface of the tempering roller, an air layer forms between the roller circumference. This air layer arises because both the material web and the roller entrain air molecules in the boundary layer and because the radially inwardly directed forces, which arise by tensile stress on the web, are partially eliminated by centrifugal forces. The higher the speed the moving material web is, the greater this effect is. The aforementioned air layer hinders heat transfer between the tempering roller and the material web.

It is an object of the invention, in a calender of the kind mentioned hereinbefore, to improve the heat transfer between the tempering roller and the material web.

SUMMARY OF THE INVENTION

The object is achieved according to the present invention by a charging device which .electrostatically charges the material web moving towards the tempering roller.

The positively or negatively charged material web is therefore attracted by electrostatic forces by the surface of the tempering roller, which as a rule has an earth potential (i.e., is grounded). The charging device should be arranged in such a region that the material web, when approaching the roller surface is already charged, but on the other hand no great losses of charge should have occurred. Due to the electrostatic attraction, the air gap between the material web and the tempering roller is reduced. Therefore, the heat transfer value is improved. With a given tempering roller, therefore, the quantity of heat transferred can be increased or the same quantity of heat can be achieved with a smaller area of contact between the material web and the tempering roller, whether by a smaller angle of wrap or a smaller roller diameter.

Advantageously, the charging device is associated with the side of the material web which comes to rest on the tempering roller. Compared with charging the opposite side of the material web, the advantage arises that the maximum possible electrostatic force occurs. The charged regions are disposed closely adjacent to the roller circumference by a layer of web material which is possibly a poor conductor of electricity.

It is particularly favorable that the charging device is arranged in the wedge space which is formed between the surface of the tempering roller and the incoming material web. In this wedge space, the charging device acquires a maximum possible effect. Also, no extra space requirements arise for use of the charging device.

It is preferred that the material web be applied to the tempering roller by means of a guide roller, and that the charging device is arranged between the guide roller and the tempering roller. On application of the material web to the tempering roller, in the known cases there is a particularly great risk of air locks occurring. This risk is considerably reduced according to the present invention.

This also applies if the tempering roller is a pressing roller which defines the pressing gap. One need only arrange the charging device near this pressing roller, offset from the pressing gap in the circumferential direction.

In a preferred embodiment, it is ensured that a control device is provided which, on closure of the pressing gap, applies the material web to the tempering roller by means of the guide roller and, on opening of the pressing gap, displaces the guide roller so far that the material web is completely lifted off the tempering roller. For one thing, on separation of the pressing rollers the material web can be passed through the open pressing gap without contact. Thus, even if the pressing rollers are braked, no harmful friction effects arise between material web and pressing rollers. In addition, in spite of the material web being completely lifted off, on moving the pressing rollers together the original state can be reproduced very rapidly.

All known constructions are possible as charging devices. It is preferred that the charging device comprises charge-generating electrodes. Particularly, suitable for this are emission electrodes applied to a high voltage. In an alternative embodiment, the charging device comprises bodies which generate charges by frictional electricity and which the moving material web contacts. Bodies of this kind can be made of plastic, rubber or the like.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PRESENTLY PREFERRED EMBODIMENTS

Figure 1:
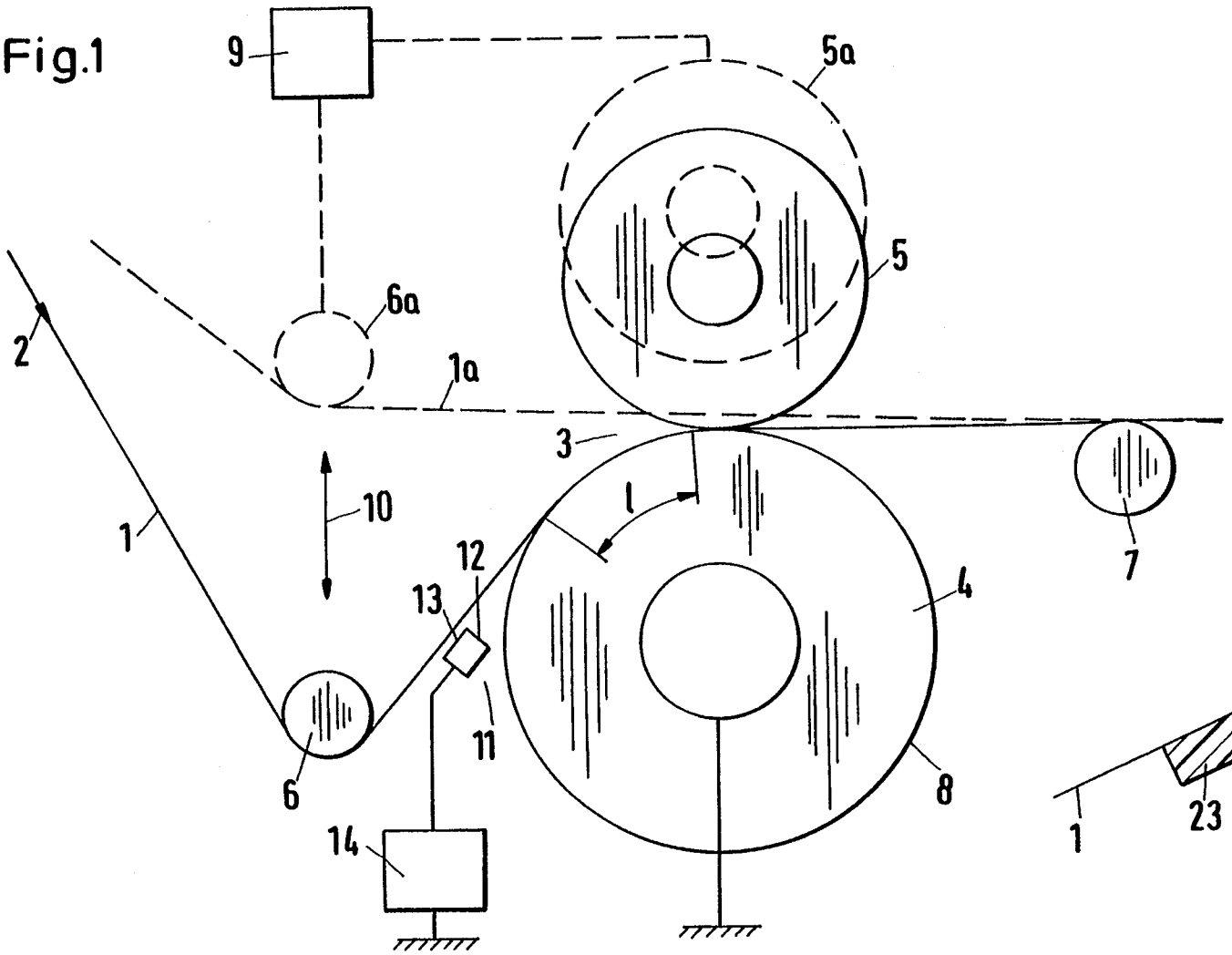
FIG. 1 is a schematic view of the essential part of a calender according to the present invention.

Referring now to FIG. 1, a material web 1 of paper, plastic or the like is supplied in the direction of arrow 2 and is subjected to pressure treatment in a pressing gap 3. Pressing gap 3 is defined by a lower tempering roller 4, which is heatable, and by an upper pressing roller 5. Two guide rollers 6 and 7 ensure that the material web 1 contacts the circumference 8 of the tempering roller 4 over a circumferential section I which is located in front of the pressing gap 3. The material web is therefore preheated on entering the pressing gap 3. The energy of deformation is thus supplied partly thermally and partly mechanically.

By means of a control device 9, the upper pressing roller 5 is displaceable into a position 5*a* and at the same time, the guide roller 6 is displaceable into a position 6*a*. In this position, the material web 1*a* passes through the now open pressing gap 3 without contact. On closure of the pressing gap and return movement of the guide roller 6 according to the double arrow 10, the material web 1 is applied to the surface 8 of the tempering roller successively.

In a wedge space 11, which is formed between the material web and the surface 8 of the tempering roller 4, a charging device 12 is disposed. The wedge space 11 is formed by a surface of the tempering roller 4, a surface of an incoming material web and a plane which is tangent to the tempering roller surface and perpendicular to the incoming material web surface. Charging device 12 has a row of emission electrodes 13 which are arranged across the full width of the material web 1. A voltage generator 14 supplies the electrodes 13 with its high-tension output. The other terminals of the voltage generator 14 and the tempering roller 4 are earthed or grounded.

Charging device 12 provides the lower side of the material web 1 with a charge. This causes electrostatic forces of attraction to arise between material web 1 and surface 8. Thus, any air layer which forms between material web 1 and surface 8 is kept small, which leads to a very good heat transfer between roller 4 and material web 1.

Figure 2:
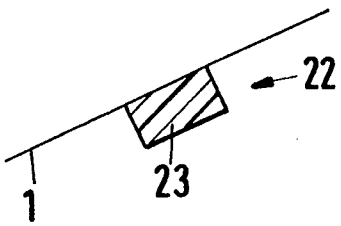
FIG. 2 shows an alternative form of the charging device.

FIG. 2 shows a modified charging device 22. Charging device 22 consists essentially of a rod-shaped body 23 made of plastic, over which the material web 1 slides with friction. In this way too, the lower side of the material web 1 is provided with charges which lead to the desired electrostatic forces of attraction.

There can be deviations from the embodiment shown in many respects without departing from the basic concept of the invention. For example, the tempering rollers can also be arranged outside the pressing zone. In addition, coolable tempering rollers can be used in lieu of the heatable tempering rollers.

From the foregoing description, it will be appreciated that the present invention makes available, a compact, cost efficient calender for material webs. The calender is designed to allow for simple operation while providing a good heat transfer to the material web.

Having described the presently preferred exemplary embodiment of a new and improved calender in accordance with the present invention, it is believed that other modifications, variations and changes will be suggested to those skilled in the art in view of the teachings set forth herein. It is, therefore, to be understood that all such variations, modifications, and changes are believed to fall within the scope of the present invention as defined by the appended claims.

What I claim is:

1. A calender for material webs of paper or plastic comprising:

at least one pressing nip being defined by at least one temperature controlled tempering roller and a pressing roller, a charging device disposed adjacent to said nip, said charging device electrostatically charging the material web before said material web contacts the tempering roller, said charging device being disposed in a wedge space which is formed by a surface of said tempering roller, a surface of said incoming material web and a plane which is tangent to said tempering roller surface and perpendicular to said incoming material web surface.

2. The calender according to claim 1, wherein the charging device is disposed on the side of the material web which contacts the tempering roller.

3. The calender according to claim 2, further comprising a guide roller to apply the material web to the tempering roller, and wherein the charging device is disposed between the guide roller and the tempering roller.

4. The calender according to claim 3, wherein the charging device is disposed adjacent to the tempering roller and offset from the pressing nip in the circumferential direction.

5. The calender according to claim 4, further comprising means for closing and opening the pressing nip by displacement of the pressing roller toward and away from the tempering roller, respectively, and a control device which, on closing of the pressing nip, applies the material web to the tempering roller by means of the guide roller and, on opening of the pressing nip, displaces the guide roller so that the material web is spaced from the tempering roller.

6. The calender according to claim 5, wherein the charging device comprises charge-generating electrodes.

7. The calender according to claim 5, wherein the charging device comprises bodies which generate charges by frictional electricity and which the moving material web contacts.

* * * * *